US010920757B2

(12) United States Patent
Morita et al.

(10) Patent No.: US 10,920,757 B2
(45) Date of Patent: Feb. 16, 2021

(54) LIQUID PRESSURE ROTARY MACHINE

(71) Applicant: KOBE STEEL, LTD., Hyogo (JP)

(72) Inventors: Kei Morita, Kobe (JP); Naoki Sugano, Kobe (JP); Satoshi Maekawa, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 28 days.

(21) Appl. No.: 16/445,740

(22) Filed: Jun. 19, 2019

(65) Prior Publication Data

US 2020/0018298 A1 Jan. 16, 2020

(30) Foreign Application Priority Data

Jul. 12, 2018 (JP) ..... 2018-132264

(51) Int. Cl.

| | |
|---|---|
| ***F04B 1/2085*** | (2020.01) |
| ***F04B 1/324*** | (2020.01) |
| ***F04B 1/20*** | (2020.01) |
| ***F04B 1/30*** | (2020.01) |

(52) U.S. Cl.

CPC ..... *F04B 1/2085* (2013.01); *F04B 1/20* (2013.01); *F04B 1/30* (2013.01); *F04B 1/324* (2013.01)

(58) Field of Classification Search

CPC .... F04B 1/20; F04B 1/30; F04B 1/324; F04B 1/2085

USPC ..... 92/12.2, 13; 417/222.1–222.2, 269–271

See application file for complete search history.

(56) References Cited

U.S. PATENT DOCUMENTS 2,231,100 A * 2/1941 Wahlmark ..... F01B 3/0023 91/54
2,718,758 A * 9/1955 Minshall ..... F16H 39/42 60/451
2,953,099 A * 9/1960 Budzich ..... F04B 1/2085 91/507

(Continued)

FOREIGN PATENT DOCUMENTS

| | | | |
|---|---|---|---|
| DE | 19906540 | A1 | 8/2000 |
| EP | 3438451 | A1 | 2/2019 |
| JP | 2017180448 | A | 10/2017 |

OTHER PUBLICATIONS

The extended European search report issued by the European Patent Office dated Oct. 16, 2019, which corresponds to European Patent Application No. 19181085.2-1004 and is related to U.S. Appl. No. 16/445,740.

*Primary Examiner* — Alexander B Comley

(74) *Attorney, Agent, or Firm* — Studebaker & Brackett PC

(57) ABSTRACT

A liquid pressure rotary machine in which a rotation delay of a retainer with respect to a cylinder block is reduced and contact of pistons placed between the retainer and the cylinder block with peripheral members is suppressed is provided.

A piston pump includes a rotation shaft, a cylinder block, piston heads, piston rods, a retainer, a swash plate, and a tilt adjustment mechanism. When the tilt adjustment mechanism swings the swash plate, a discharge amount of the piston pump becomes variable. The retainer to be rotated together with the piston heads and the piston rods is supported by a retainer bushing provided in the rotation shaft. By engaging ball pins of the retainer bushing with spherical surface pin grooves of the retainer, the retainer and the (Continued)

retainer bushing are integrally rotatable about the center axis of the rotation shaft and the retainer is swung about the spherical surface center.

5 Claims, 9 Drawing Sheets

(56) References Cited

U.S. PATENT DOCUMENTS 3,070,031 A * 12/1962 Puryear ..... F04B 1/2042 417/222.1
3,682,047 A * 8/1972 Anderson ..... F04B 1/2078 91/505
3,739,692 A * 6/1973 Bell ..... F04B 1/324 91/506
3,783,744 A * 1/1974 Benkovic ..... F04B 1/126 92/57
3,803,985 A * 4/1974 Maistrelli ..... F01B 3/0088 91/488
3,810,715 A * 5/1974 Week ..... F04B 1/324 417/213
4,232,587 A * 11/1980 Kline ..... F04B 1/20 91/499
5,515,768 A * 5/1996 Fritz ..... F01B 3/0032 417/222.1
5,758,566 A * 6/1998 Jepsen ..... F04B 1/2035 403/130
6,312,231 B1 * 11/2001 Kuhne ..... F04B 1/2085 417/222.1
8,425,699 B2 * 4/2013 Mori ..... C21D 1/09 148/565
2009/0084258 A1 * 4/2009 Stoelzer ..... F04B 1/2078 91/505

* cited by examiner

LIQUID PRESSURE ROTARY MACHINE

BACKGROUND OF THE INVENTION

Field of the Invention

The present invention relates to a liquid pressure rotary machine utilizable as a hydraulic pump and a hydraulic motor.

Description of the Related Art

Conventionally, a variable capacity type liquid pressure rotary machine utilizable as a hydraulic pump and a hydraulic motor is known. Such a liquid pressure rotary machine includes a housing, a rotation shaft, a cylinder block, and plural pistons. The rotation shaft is rotatably and axially supported by the housing. The cylinder block includes plural cylinders formed about the center axis of the rotation shaft, and is rotated together with the rotation shaft. The pistons are respectively housed in the plural cylinders of the cylinder block, and make reciprocating motion in accordance with rotation of the cylinder block.

In a case where the liquid pressure rotary machine is used as a hydraulic pump, by rotating the rotation shaft by an output of a predetermined drive portion, the cylinder block is rotated together with the rotation shaft and each of the pistons makes the reciprocating motion. At this time, working oil flows from a predetermined low pressure port into the cylinder of the cylinder block, and is pressurized by the piston and discharged from a predetermined high pressure port.

Meanwhile, in a case where the liquid pressure rotary machine is used as a hydraulic motor, by high-pressure working oil flowing from a high pressure port into the cylinder of the cylinder block, the flowing working oil acts on the piston. After the reciprocating motion of the piston rotates the rotation shaft together with the cylinder block, the working oil is discharged from a low pressure port.

JP 2017-180448 A discloses a variable capacity type liquid pressure rotary machine with a swash plate. The liquid pressure rotary machine includes a retainer bushing, a retainer, a swash plate, a thrust bearing, and a tilt adjustment mechanism in addition to the constituent elements described above. The retainer bushing includes a bushing outer peripheral surface formed in a spherical surface shape projected toward the radially outside in rotation of the rotation shaft, and is supported on the rotation shaft so as to be rotatable in conjunction with the rotation of the rotation shaft. The retainer includes a retainer inner peripheral surface formed in a recessed spherical surface shape, the retainer inner peripheral surface being slidable with respect to the bushing outer peripheral surface. The retainer is supported by the retainer bushing so as to be swingable about the axis orthogonal to the rotation shaft. Further, the swash plate is arranged to oppose the retainer on the axially opposite side to the cylinder block, and supported by the housing so as to be swingable about the axis. The thrust bearing is placed between the swash plate and the retainer in the axial direction, and supports the retainer in such a manner that the retainer is rotatable about the center axis with respect to the swash plate. The tilt adjustment mechanism swings, by swinging the swash plate about the axis, the retainer about the axis while bringing the retainer inner peripheral surface and the bushing outer peripheral surface into sliding contact, and adjusts an axially moving amount of the pistons in the reciprocating motion.

With such a liquid pressure rotary machine, since the retainer and the swash plate are connected by the thrust bearing, it is possible to suppress sliding resistance occurring in a conventional hydraulic pump with a swash plate. Since the reciprocating pistons and the swash plate are not in direct sliding contact with each other, it is possible to set a low leakage amount of the working oil supplied as a lubricant. As a result, it is possible to improve volumetric efficiency of the liquid pressure rotary machine.

In the liquid pressure rotary machine described in JP 2017-180448 A, the cylinder block is rotated integrally with the rotation shaft. Meanwhile, by receiving rotation force from the cylinder block through the pistons, the retainer is rotated so as to follow the cylinder block. In this case, a phase delay easily occurs between the retainer and the cylinder block. As a result, the pistons are brought into contact with the cylinder block or the retainer, and there is a possibility that part of the members is damaged.

SUMMARY OF THE INVENTION

The present invention is achieved in consideration with the above problem, and an object thereof is to provide a liquid pressure rotary machine in which a rotation delay of a retainer with respect to a cylinder block is reduced and contact of pistons placed between the retainer and the cylinder block with peripheral members is suppressed.

A variable capacity type liquid pressure rotary machine according to an aspect of the present invention is a variable capacity type liquid pressure rotary machine including a housing, a rotation shaft rotatably and axially supported by the housing, a cylinder block including plural cylinders arranged and spaced from each other about the rotation shaft, the cylinder block to be rotated about the center axis of the rotation shaft integrally with the rotation shaft, plural pistons respectively housed in the plural cylinders of the cylinder block, the pistons that make reciprocating motion in accordance with rotation of the cylinder block along the axial direction of the rotation in the cylinder, a retainer bushing including a bushing outer peripheral surface which is formed in a spherical surface shape projected toward the radially outside in rotation of the rotation shaft, the retainer bushing being supported on the rotation shaft so as to be rotatable about the center axis together with the rotation shaft, a retainer including a retainer inner peripheral surface which is formed in a recessed spherical surface shape arranged to oppose the bushing outer peripheral surface, the retainer being supported by the retainer bushing so as to be swingable about the axis orthogonal to the rotation shaft, plural piston rods arranged to extend in the axial direction, the piston rods that respectively connect the plural pistons and the retainer, and rotate the retainer about the center axis in conjunction with rotation of the plural pistons about the center axis, a swash plate arranged to oppose the retainer on the axially opposite side to the cylinder block, the swash plate being supported by the housing so as to be swingable about the axis, a thrust bearing placed between the swash plate and the retainer in the axial direction, the thrust bearing that supports the retainer in such a manner that the retainer is rotatable about the center axis with respect to the swash plate, and a tilt adjustment mechanism that, by swinging the swash plate about the axis, swings the retainer about the axis through the thrust bearing while relatively displacing the retainer inner peripheral surface and the bushing outer peripheral surface, and adjusts an axially moving amount of the pistons in the reciprocating motion, wherein the retainer bushing has at least one projecting portion projecting from the bushing outer peripheral surface toward the radially outside, the projecting portion whose leading end portion is formed in a spherical surface shape, at least one groove portion extending along the direction in which the retainer is swung about the axis is formed on the retainer inner peripheral surface of the retainer, and by engaging the at-least-one projecting portion with the at-least-one groove portion, the retainer and the retainer bushing are integrally rotatable about the center axis, and by moving the plural projecting portions in the plural groove portions, the retainer is swingable about the axis.

With this configuration, since the cylinder block is rotated together with the rotation shaft and the pistons make the reciprocating motion in the cylinders, the liquid pressure rotary machine can function as a hydraulic pump or a hydraulic motor. Since the retainer and the swash plate are connected by the thrust bearing, it is possible to reduce sliding resistance at the time of rotating the retainer. Further, since the reciprocating pistons and the swash plate are not in direct sliding contact, it is possible to set a low leakage amount of working oil supplied as a lubricant. As a result, it is possible to improve volumetric efficiency of the liquid pressure rotary machine. The retainer to be rotated together with the cylinder block is supported by the retainer bushing provided in the rotation shaft. The retainer bushing has the at-least-one projecting portion, and the at-least-one groove portion is formed in the retainer. By engaging the at-least-one projecting portion with the at-least-one groove portion, the retainer and the retainer bushing are integrally rotatable about the center axis, and by moving the at-least-one projecting portion in the at-least-one groove portion, the retainer is swingable about the axis. Therefore, since a rotation phase of the rotation shaft is substantially matched with a rotation phase of the retainer, it is possible to reduce a rotation delay of the retainer with respect to the cylinder block. As a result, abnormal tilt of the piston rods is suppressed, and contact of the pistons and the piston rods placed between the cylinder block and the retainer with peripheral members such as the retainer and the cylinder block is suppressed. As a result, it is possible to improve durability of the liquid pressure rotary machine.

In the above configuration, desirably, the at-least-one projecting portion includes plural projecting portions arranged and spaced from each other along the rotation direction of the rotation shaft, and the at-least-one groove portion includes plural groove portions arranged and spaced from each other along the rotation direction.

With this configuration, it is possible to stably and substantially match the rotation phase of the rotation shaft with the rotation phase of the retainer.

In the above configuration, desirably, the plural groove portions are formed in a recessed circular shape when seen in a section orthogonal to the center axis, and a curvature of the circular shape of the plural groove portions is set to be the same as a curvature of the spherical surface shape of the leading end portions of the plural projecting portions.

With this configuration, since surface pressure generated in the leading end portions of the projecting portions is uniformized, it is possible to improve durability of the projecting portions. Since sliding resistance between the projecting portions and the groove portions at the time of rotating the retainer is reduced, it is possible to improve efficiency of the liquid pressure rotary machine.

In the above configuration, desirably, the plural projecting portions are formed by even numbers of the projecting portions arranged about the center axis at equal intervals, and the plural groove portions are formed by the same numbers of the groove portions as the plural projecting portions, the groove portions being arranged about the center axis at equal intervals.

With this configuration, it is possible to stably realize swing of the retainer about the axis.

In the above configuration, desirably, the plural pistons are formed by odd numbers of the pistons arranged about the center axis at equal intervals, and the plural piston rods are formed by the same numbers of the piston rods as the plural pistons, the piston rods being arranged about the center axis at equal intervals.

With this configuration, it is possible to reduce pulsation of oil pressure occurring at the time of driving and rotating the cylinder block.

According to the present invention, the liquid pressure rotary machine in which the rotation delay of the retainer with respect to the cylinder block is reduced and contact of the pistons placed between the retainer and the cylinder block with the peripheral members is suppressed is provided.

DESCRIPTION OF THE PREFERRED EMBODIMENTS

Figure 1:
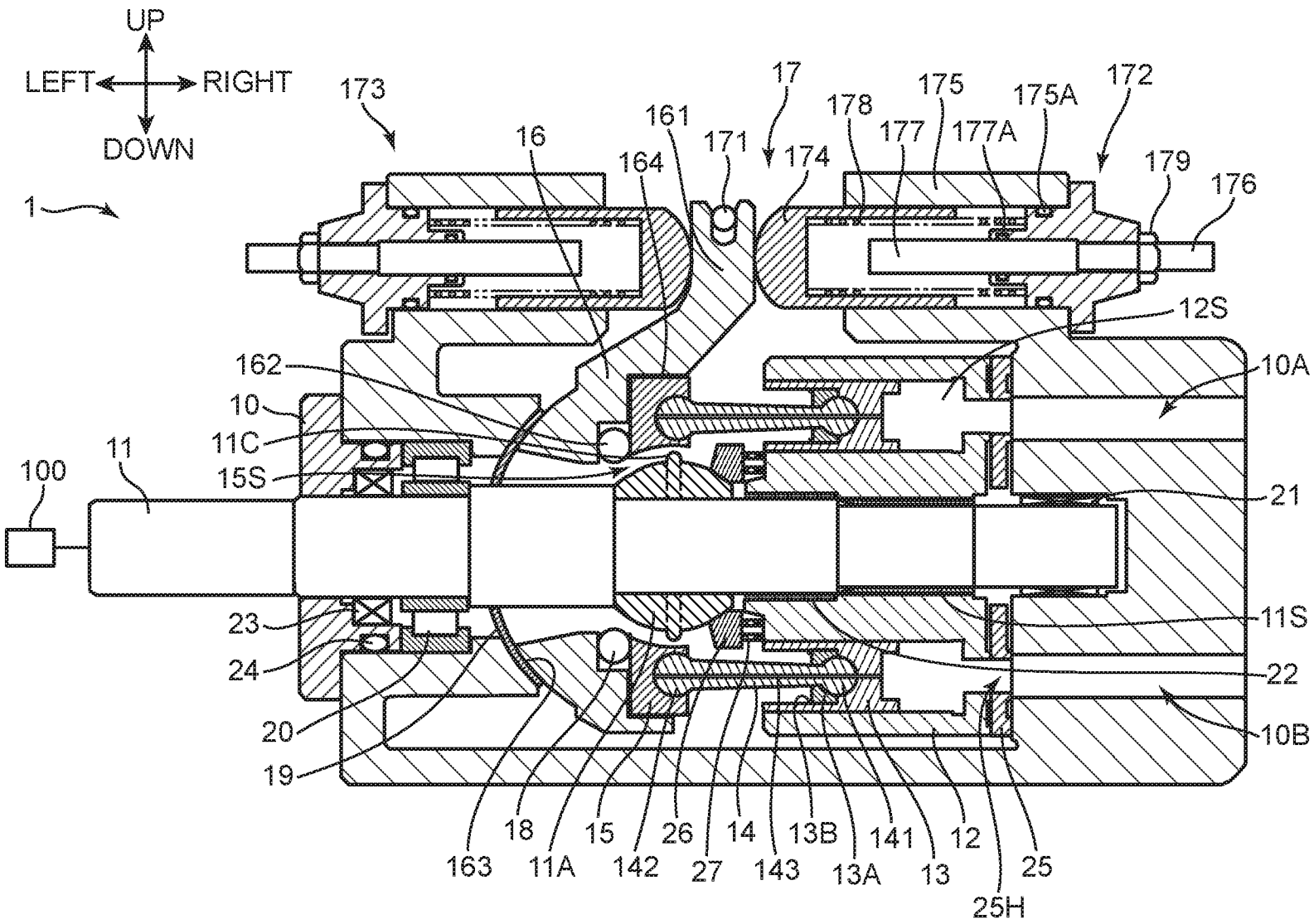
FIG. 1 is a sectional view of a case where a liquid pressure rotary machine according to an embodiment of the present invention is used as a hydraulic pump.
Figure 2:
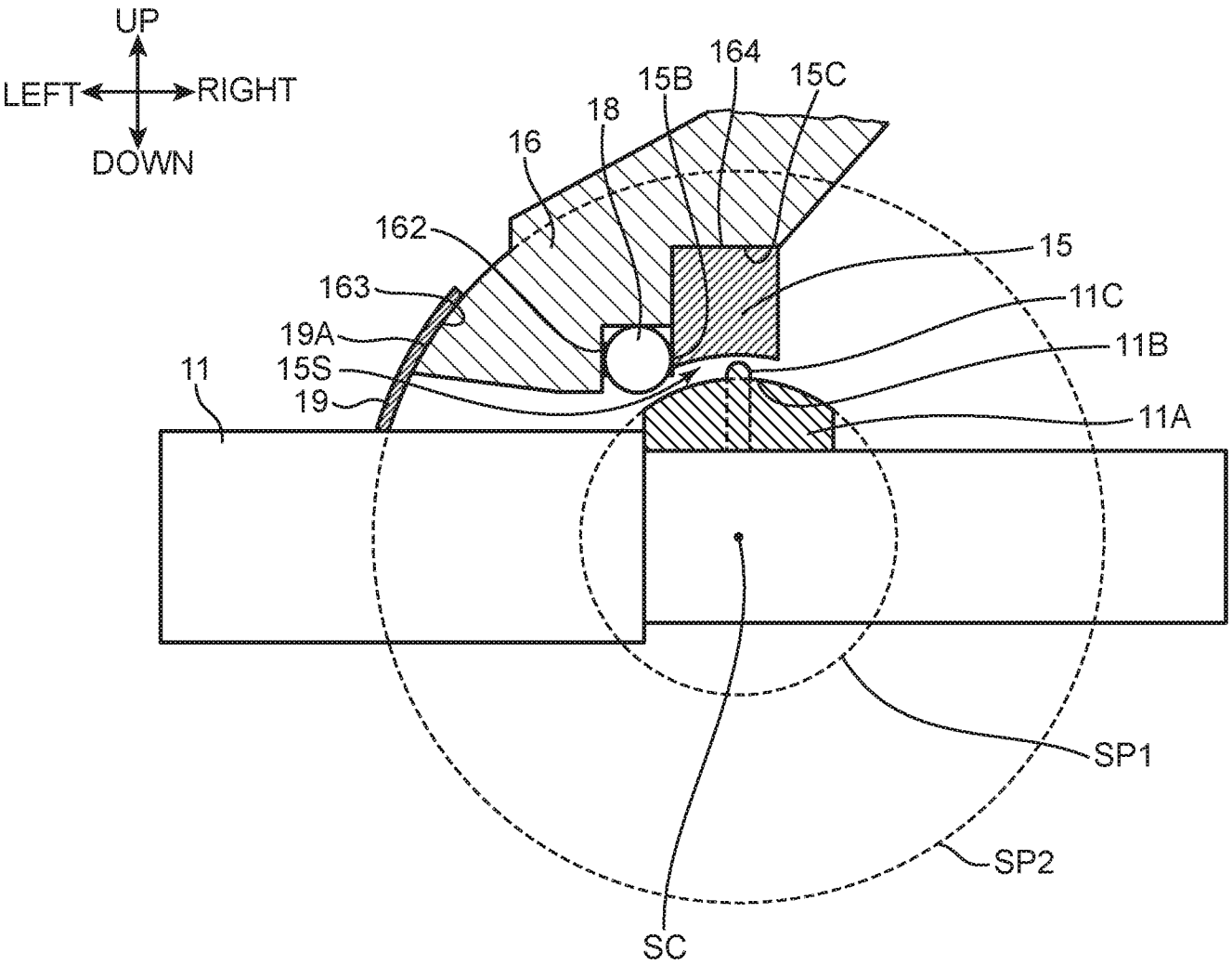
FIG. 2 is an enlarged sectional view in which part of the liquid pressure rotary machine of FIG. 1 is enlarged.
Figure 3A:
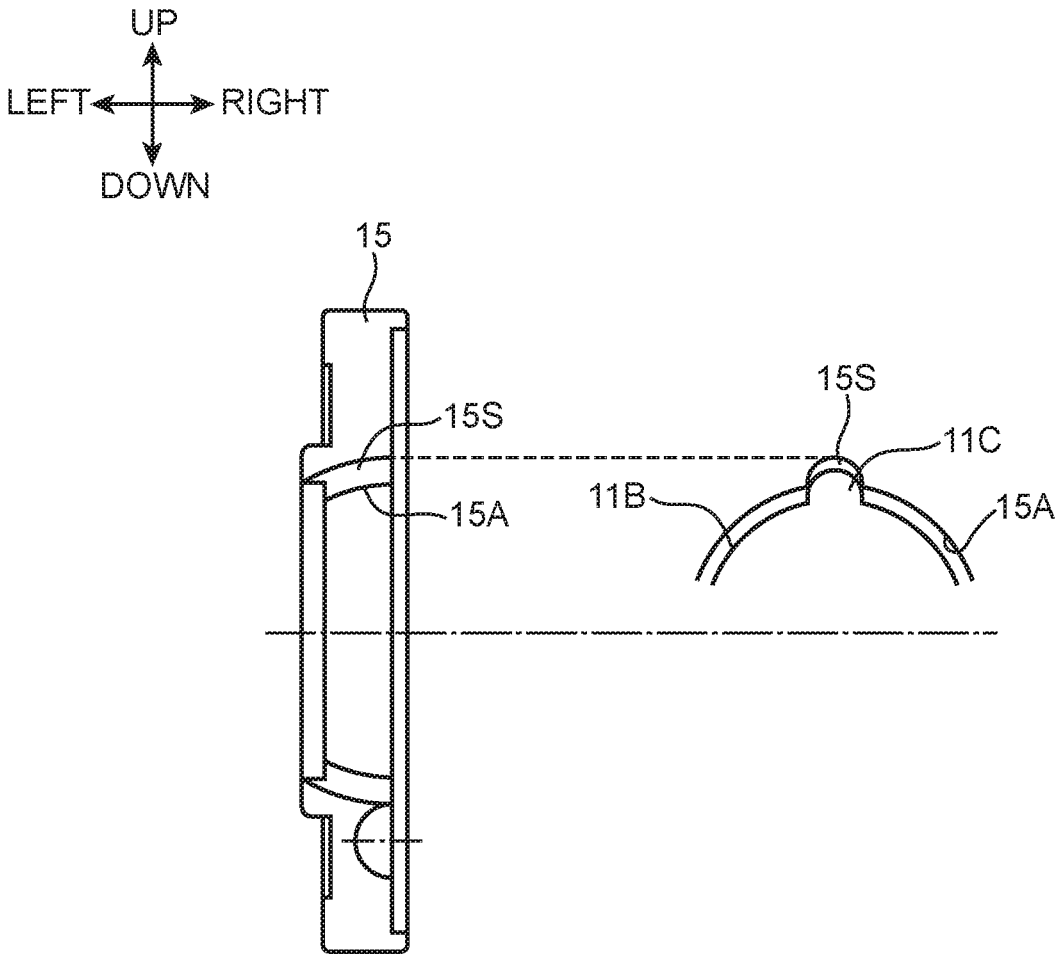
FIG. 3A is a sectional view of a retainer of the liquid pressure rotary machine of FIG. 1, and an enlarged side view showing the retainer and part of a retainer bushing.
Figure 3B:
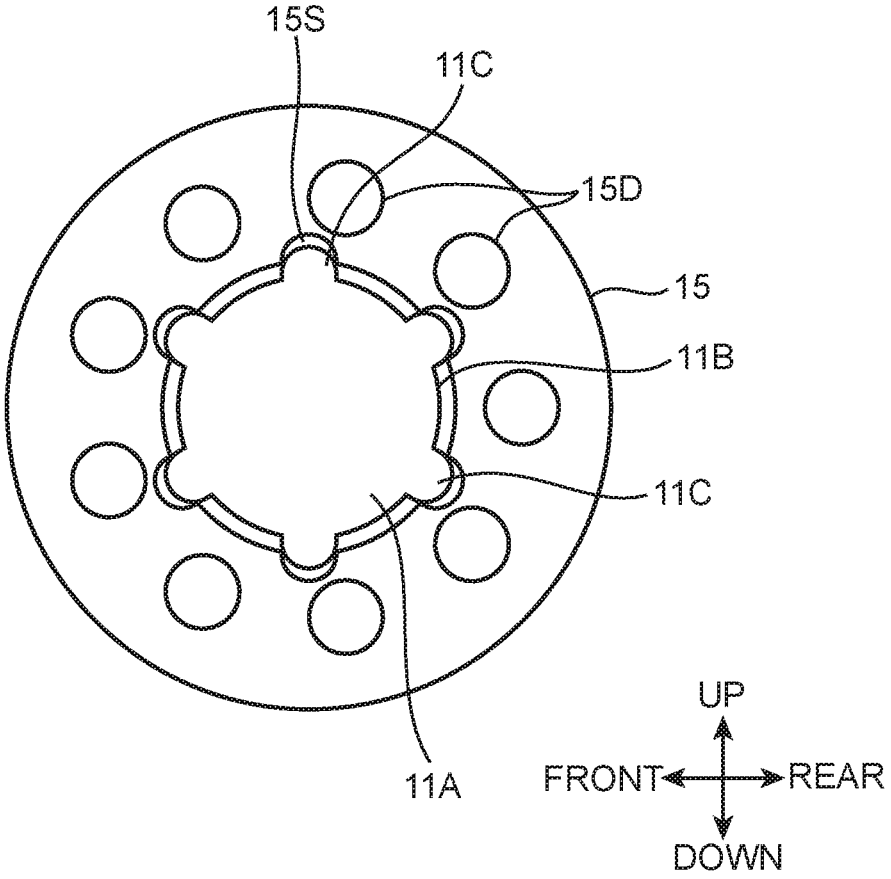
FIG. 3B is a side view showing the retainer and the retainer bushing of the liquid pressure rotary machine of FIG. 1.
Figure 4A:
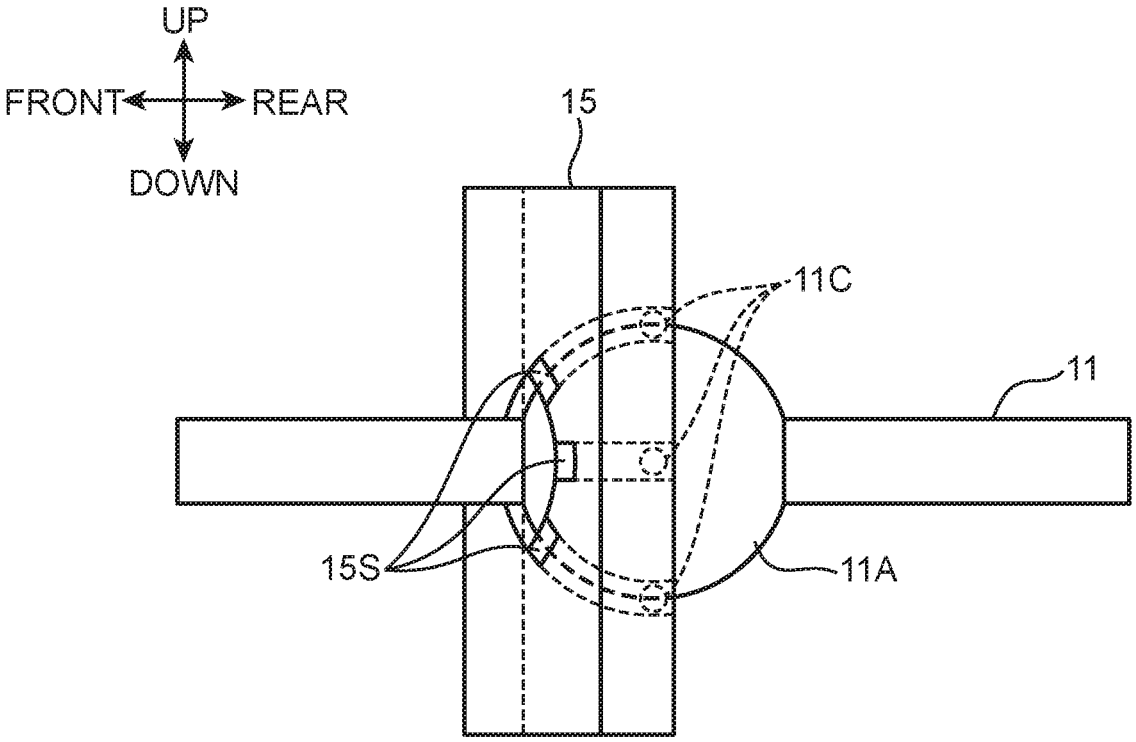
FIG. 4A is a schematic bottom view showing a rotation shaft, the retainer, and the retainer bushing of the liquid pressure rotary machine of FIG. 1.
Figure 4B:
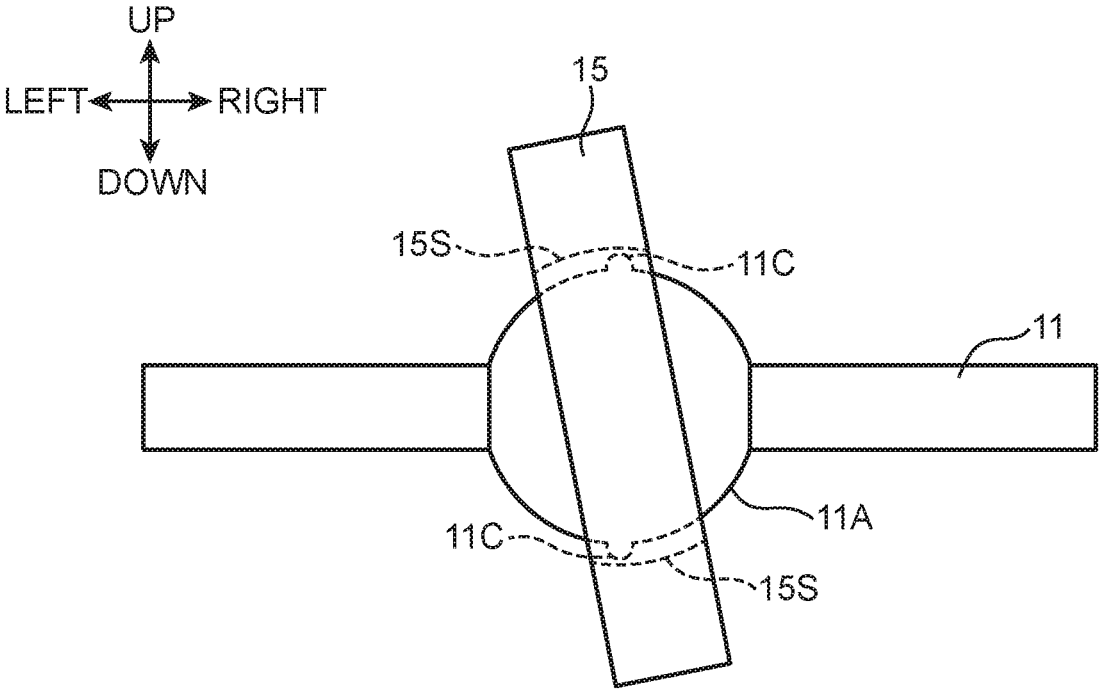
FIG. 4B is a schematic front view showing the rotation shaft, the retainer, and the retainer bushing of the liquid pressure rotary machine of FIG. 1.
Figure 5:
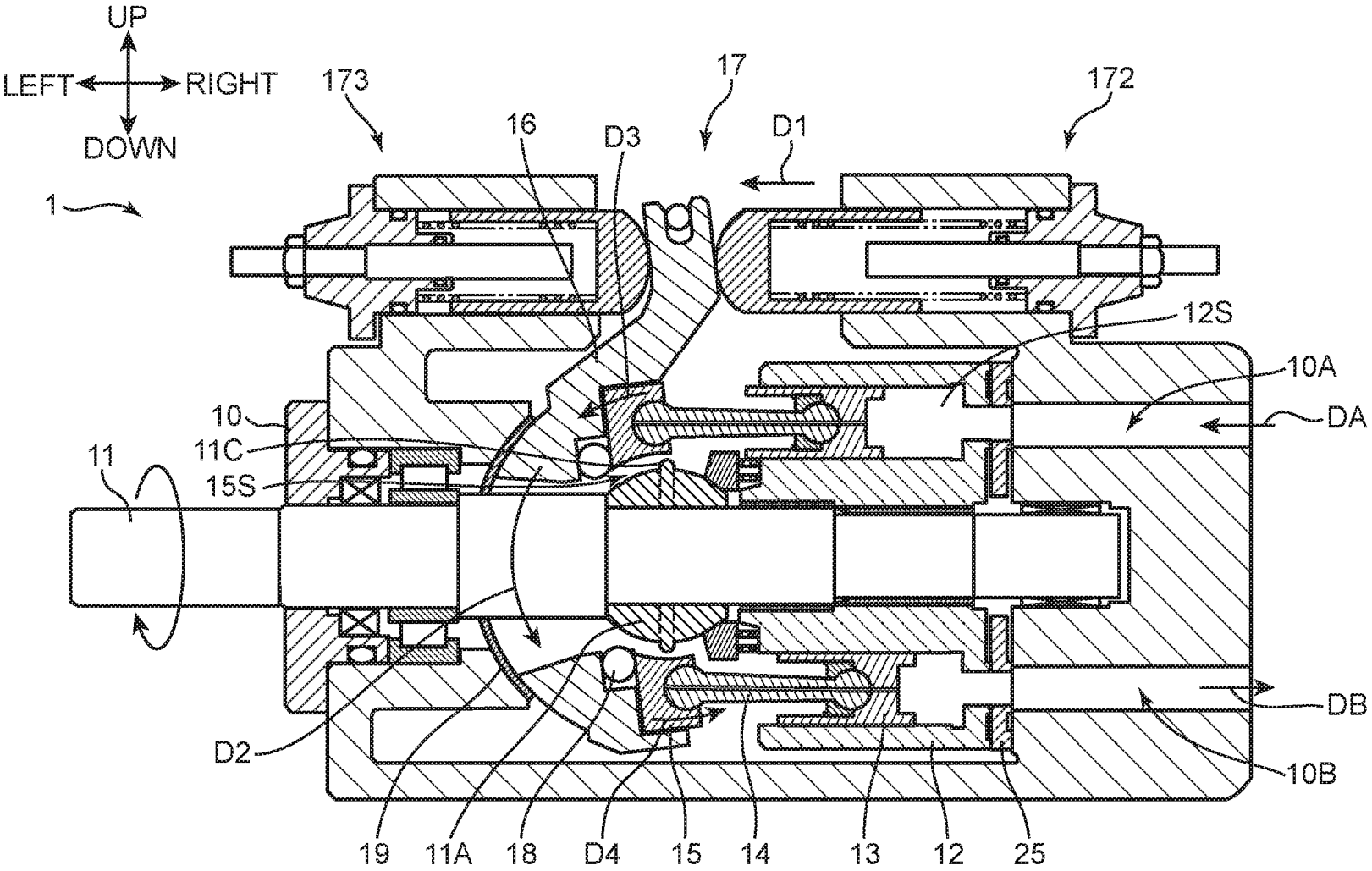
FIG. 5 is a sectional view showing a situation where a swash plate is tilted in the liquid pressure rotary machine of FIG. 1.
Figure 6A:
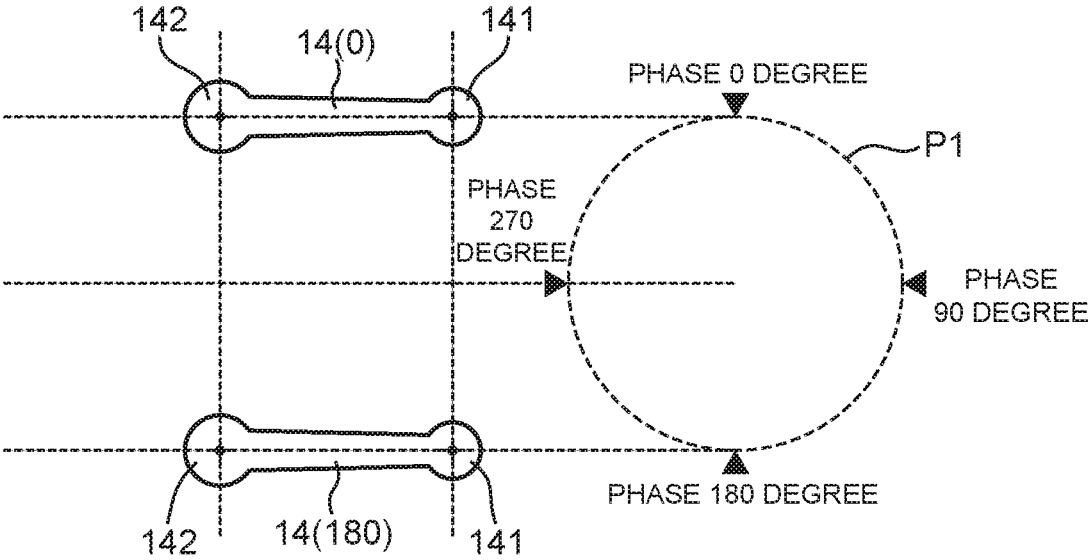
FIG. 6A is a schematic view showing a rotation trajectory of piston rods in a case where the swash plate is not tilted in the liquid pressure rotary machine according to the embodiment of the present invention.
Figure 6B:
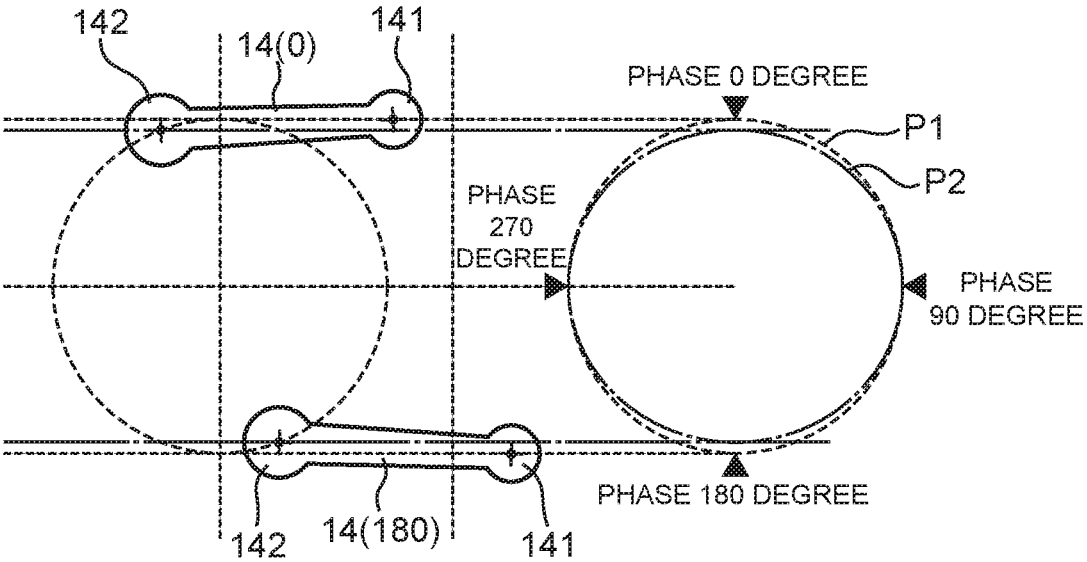
FIG. 6B is a schematic view showing a rotation trajectory of the piston rods in a case where the swash plate is tilted in the liquid pressure rotary machine according to the embodiment of the present invention.
Figure 7:
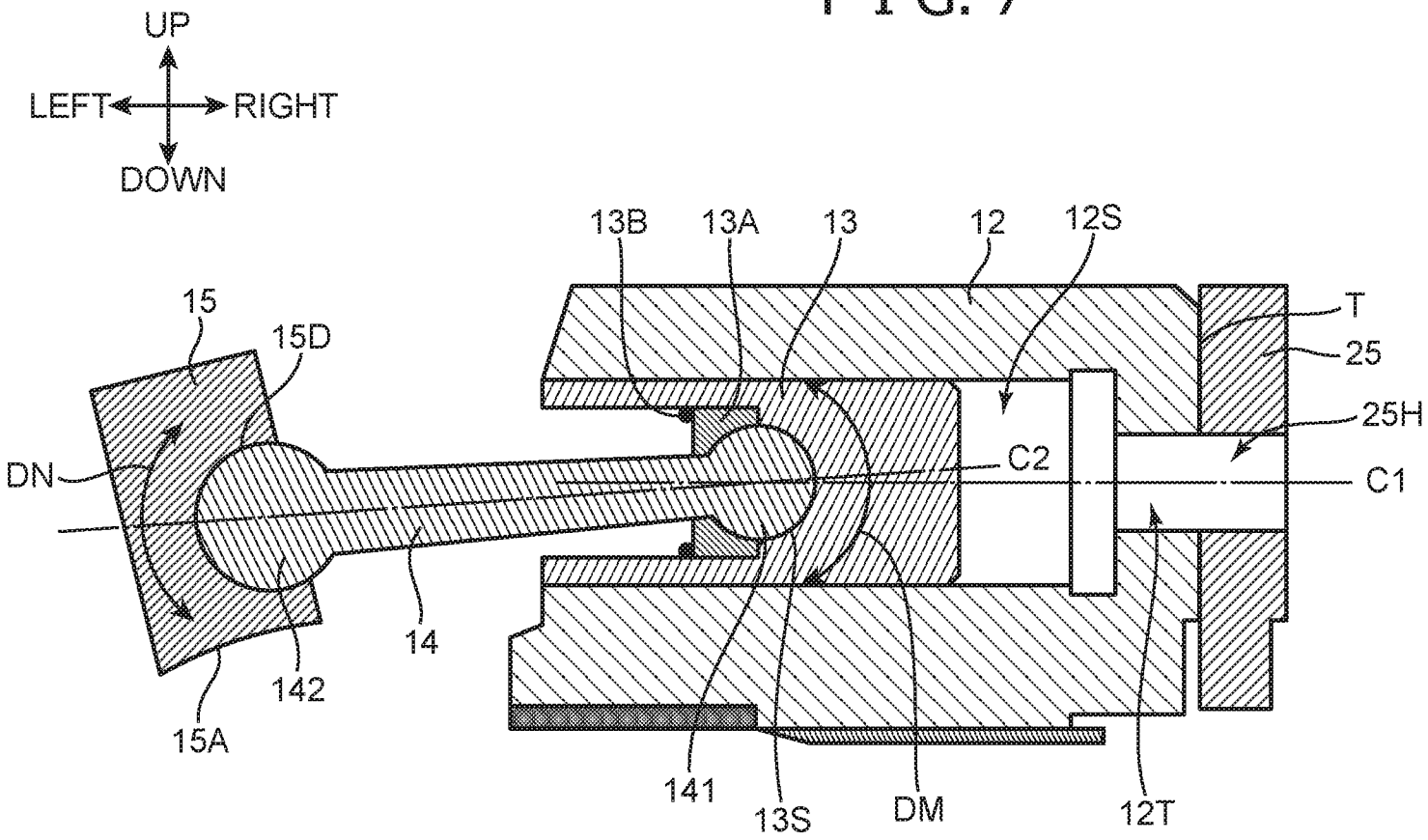
FIG. 7 is an enlarged sectional view for illustrating swing of the piston rod in the liquid pressure rotary machine according to the embodiment of the present invention.

Hereinafter, embodiments of the present invention will be described with reference to the drawings. FIG. 1 is a sectional view of a piston pump 1 according to an embodiment of a liquid pressure rotary machine of the present invention. FIG. 2 is an enlarged sectional view in which part of the piston pump 1 of FIG. 1 is enlarged. FIG. 3A is a sectional view of a retainer 15 of the piston pump 1 of FIG. 1, and an enlarged side view showing the retainer 15 and part of a retainer bushing 11A. FIG. 3B is a side view showing the retainer 15 and the retainer bushing 11A of the piston pump 1 of FIG. 1. FIG. 4A is a schematic bottom view showing a rotation shaft 11, the retainer 15, and the retainer bushing 11A of the piston pump 1 of FIG. 1. FIG. 4B is a schematic front view showing the rotation shaft 11, the retainer 15, and the retainer bushing 11A of the piston pump 1 of FIG. 1. FIG. 5 is a sectional view showing a situation where a swash plate 16 to be described later is tilted in the piston pump 1 of FIG. 1. FIG. 6A is a schematic view showing a rotation trajectory of piston rods 14 in a case where the swash plate 16 is not tilted in the piston pump 1, and FIG. 6B is a schematic view showing a rotation trajectory of the piston rods 14 in a case where the swash plate 16 is tilted. Further, FIG. 7 is an enlarged sectional view for illustrating swing of the piston rod 14 in the piston pump 1. Hereinafter, the "up", "down", "front", and "rear" directions are shown in the figures. However, the directions are shown for convenience for illustrating a structure of the piston pump 1 according to the present embodiment, and do not limit use modes of the piston pump 1, etc. In FIGS. 1 and 5, in order to simplify description and facilitate understanding, the retainer bushing 11A, a cylinder block 12, piston heads 13, the piston rods 14, and the retainer 15 are substantially symmetrical in the up and down direction with respect to the rotation shaft 11. In the present embodiment, as described later, nine (odd numbers of) piston heads 13 and nine (odd numbers of) piston rods 14 are arranged about the rotation shaft 11. Therefore, in reality, the piston head 13 and the piston rod 14 on the lower side in FIGS. 1 and 5 are arranged at positions displaced from the positions in FIGS. 1 and 5 in the rotation direction of the rotation shaft 11 (the same applies to spherical surface pin grooves 15S and ball pins 11C to be described later). Further, the same applies to FIG. 8 to be described later.

The variable capacity type piston pump 1 according to the present embodiment functions as a hydraulic pump that discharges working oil by being connected to a drive portion 100 such as an engine. The piston pump 1 includes a housing 10, the rotation shaft 11, the cylinder block 12, the plural piston heads 13 (pistons), and the piston rods 14. Further, the piston pump 1 includes the retainer 15, the swash plate 16, a tilt adjustment mechanism 17, a thrust bearing 18, and a swash plate receiving portion 19 (swash plate supporting portion).

The housing 10 functions as a casing that supports members of the piston pump 1. The rotation shaft 11 is rotatably and axially supported by the housing 10. The rotation shaft 11 is coupled to the drive portion 100, and rotated in the arrow direction of FIG. 5 by rotation drive force generated by the drive portion 100. The left end side of the rotation shaft 11 is rotatably supported by a roller bearing 20 arranged in the housing 10. Meanwhile, the right end side of the rotation shaft 11 is similarly rotatably supported by a needle bearing 21 arranged in the housing 10. On the left side of the roller bearing 20, an oil seal 23 and an O ring 24 are arranged in order to prevent leakage of the working oil in the piston pump 1. On the right end side of the housing 10, a first flow passage 10A and a second flow passage 10B for discharging and suctioning the working oil are formed.

In a substantially center portion in the left and right direction of the rotation shaft 11, the retainer bushing 11A is provided. The retainer bushing 11A is a cylindrical member whose outer peripheral surface (retainer bushing spherical surface portion 11B) (FIG. 2) is formed in a spherical surface shape. The retainer bushing 11A is supported on the rotation shaft 11 so as to be rotatable about the center axis of the rotation shaft 11 in conjunction with rotation of the rotation shaft 11. In the present embodiment, the retainer bushing 11A is fitted to an outer peripheral portion of the rotation shaft 11 so as to be rotated integrally with the rotation shaft 11.

With reference to FIG. 2, the retainer bushing spherical surface portion 11B (bushing outer peripheral surface) is formed in a projected shape toward the radially outside in the rotation of the rotation shaft 11 and in a spherical surface shape having a first curvature on the spherical surface center SC. The spherical surface center SC is arranged on the center line (rotation axis) of the rotation shaft 11. The retainer bushing spherical surface portion 11B has a function of swingably supporting the retainer 15 to be described later. The retainer bushing 11A has the plural ball pins 11C (projecting portions) (FIGS. 1, 3A, and 3B). The plural ball pins 11C are arranged and spaced from each other along the rotation direction of the rotation shaft 11, and provided to project toward the radially outside from the retainer bushing spherical surface portion 11B. Leading end portions of the plural ball pins 11C are respectively formed in a spherical surface shape. In the present embodiment, pin holes (not shown) are formed from the retainer bushing spherical surface portion 11B toward the inside of the retainer bushing 11A. By inserting the ball pins 11C into the pin holes, as shown in FIGS. 1, 3A, and 3B, the leading end portions of the ball pins 11C are arranged on the radially outside of the retainer bushing spherical surface portion 11B.

In the present embodiment, the plural ball pins 11C are formed by even numbers of the ball pins 11C arranged about the center axis of the rotation shaft 11 at equal intervals, in detail, six ball pins 11C (FIG. 3B).

The cylinder block 12 is a substantially cylindrical unit arranged around the rotation shaft 11. The cylinder block 12 is engaged with the rotation shaft 11 by a spline 11S. As a result, the cylinder block 12 is rotated about the center axis of the rotation shaft 11 integrally with the rotation shaft 11. A bushing 22 is inserted between the rotation shaft 11 and an inner peripheral surface of the cylinder block 12 on the left side of the spline 11S. The bushing 22 has a function of absorbing swing of the cylinder block 12 generated by backlash of the spline 11S at the time of rotating the cylinder block 12.

The cylinder block 12 includes plural cylinders 12S arranged and spaced from each other about the rotation shaft 11. The cylinders 12S are cylindrical space portions extending in the left and right direction. In the present embodiment, nine cylinders 12S are provided about the rotation shaft 11 at equal intervals. A control opening 12T (see FIG. 7) is formed in each of the cylinders 12S. Meanwhile, a valve plate 25 is fixed between the cylinder block 12 and a right end side part of the housing 10. The valve plate 25 is not rotated but slides with respect to the cylinder block 12 (see a sliding surface T of FIG. 7). The valve plate 25 is a member formed in a substantial disc shape arranged around the rotation shaft 11. Plural valve opening portions 25H are formed in the valve plate 25. Some of the valve opening portions 25H communicate with the first flow passage 10A described above, and the other valve opening portions 25H communicate with the second flow passage 10B. When the cylinder block 12 is rotated together with the rotation shaft 11, the control openings 12T (FIG. 7) of the plural cylinders 12S communicate with the first flow passage 10A or the second flow passage 10B in order through the valve opening portions 25H. As in the present embodiment, in a case where the liquid pressure rotary machine functions as the piston pump 1, the cylinders 12S on the low pressure side communicate with the first flow passage 10A on the suction side, and the cylinders 12S on the high pressure side communicate with the second flow passage 10B on the discharge side (FIG. 5). Meanwhile, in a modified embodiment to be described later, in a case where the liquid pressure rotary machine functions as a piston motor 1A (see FIG. 8), the cylinders 12S on the high pressure side communicate with the second flow passage 10B on the suction side, and the cylinders 12S on the low pressure side communicate with the first flow passage 10A on the discharge side.

The piston heads 13 are respectively housed in the plural cylinders 12S of the cylinder block 12. In accordance with rotation of the cylinder block 12, the piston heads 13 are rotated about the center axis of the rotation shaft 11 together with the cylinder block 12 while making reciprocating motion along the axial direction (left and right direction) in the cylinders 12S. In accordance with the reciprocating motion of the piston heads 13, the volume of the cylinders 12S is changed, and the working oil is suctioned and discharged.

The plural piston rods 14 are arranged to extend in the axial direction (left and right direction) of the rotation shaft 11, and respectively connect the plural piston heads 13 and the retainer 15. As a result, the piston rods 14 have a function of rotating the retainer 15 about the center axis in conjunction with rotation of the plural piston heads 13 about the center axis. Each of the piston rods 14 is a rod member formed in a substantially columnar shape. In more detail, the piston rod 14 includes a head side end portion 141 (one end side) and a retainer side end portion 142 (the other end side). An oil groove 143 extending in the left and right direction is formed inside the piston head 13 and the piston rod 14. The oil groove 143 feeds part of the working oil in the cylinder 12S between the retainer side end portion 142 and the retainer 15. As a result, when the rotation shaft 11 is rotated in accordance with actions of the piston pump 1, galling of the piston heads 13, the piston rods 14, and the retainer 15 is prevented.

The head side end portion 141 is formed in a spherical shape, and coupled to a semi-spherical (spherical surface-shaped) piston head supporting portion 13S (FIG. 7) (first coupling portion) formed inside the piston head 13. The head side end portion 141 and the piston head supporting portion 13S are in surface contact with each other along spherical surfaces thereof. That is, the head side end portion 141 of the piston rod 14 and the piston head supporting portion 13S are coupled relatively turnably. The left end side of the head side end portion 141 is locked by a head fixing ring 13A (FIGS. 1 and 7). Further, the head fixing ring 13A is fixed by a retaining ring 13B. With such a configuration, the head side end portion 141 is supported by the piston head 13 so as to be swingable in the radial direction and the circumferential direction in the rotation of the rotation shaft 11 (about the center axis of the rotation shaft 11). By coupling the head side end portions 141 to the piston heads 13, the plural piston heads 13 and the piston rods 14 are rotated integrally with the rotation shaft 11.

Similarly, the retainer side end portion 142 is formed in a spherical shape, and fitted in and coupled to a semi-spherical (spherical surface-shaped) retainer supporting portion 15D (FIG. 7) (second coupling portion) formed inside the retainer 15. With such a configuration, the retainer side end portion 142 is supported by the retainer 15 so as to be swingable in the radial direction and the circumferential direction in the rotation of the rotation shaft 11 (about the center axis of the rotation shaft). The retainer side end portion 142 and the retainer supporting portion 15D are in surface contact with each other along spherical surfaces thereof. That is, the retainer side end portion 142 of the piston rod 14 and the retainer supporting portion 15D are coupled relatively turnably. By coupling the retainer side end portions 142 to the retainer 15, the plural piston rods 14 and the retainer 15 are rotated integrally with the rotation shaft 11.

The retainer 15 is arranged to oppose the cylinder block 12 in the axial direction of the rotation shaft 11. The retainer 15 is a ring-shaped member whose inner peripheral surface (retainer spherical surface portion 15A) is formed in a predetermined spherical surface shape. The retainer spherical surface portion 15A of the retainer 15 is arranged to oppose the retainer bushing spherical surface portion 11B of the retainer bushing 11A, and slidably fitted to the retainer bushing spherical surface portion 11B. The retainer 15 is supported by the retainer bushing 11A so as to be swingable about the axis extending in the direction orthogonal to the rotation shaft 11 (in the direction crossing the rotation shaft 11 and being orthogonal to the paper plane of FIG. 1, the front and rear direction). The axis described above passes through the spherical surface center SC of FIG. 2 and extends in the direction orthogonal to the paper plane of FIG. 2.

With reference to FIG. 2, the retainer 15 includes the retainer spherical surface portion 15A (retainer inner peripheral surface) described above, a sliding portion 15B, a swash plate opposing portion 15C (retainer outer peripheral surface), and the retainer supporting portions 15D (second coupling portion) described above.

The retainer spherical surface portion 15A is an inner peripheral surface of the retainer 15 continuously extending along and around the center axis of the rotation shaft 11. The retainer spherical surface portion 15A is formed in a recessed shape toward the radially outside in the rotation of the rotation shaft 11, and in a spherical surface shape having the first curvature which is the same as the retainer bushing spherical surface portion 11B. The retainer 15 is swung leftward and rightward with the spherical surface center SC of FIG. 2 as a supporting point in accordance with swing of the swash plate 16. In the retainer spherical surface portion 15A of the retainer 15, the plural spherical surface pin grooves 15S (groove portions) arranged and spaced from each other along the direction in which the retainer 15 is rotated about the rotation shaft 11, the spherical surface pin grooves extending along the direction in which the retainer 15 is swung about the axis are formed (FIGS. 1, 3A, and 3B). When seen in a section orthogonal to the center axis of the rotation shaft 11 (FIG. 3B), the plural spherical surface pin grooves 15S are formed in a recessed circular shape. In the present embodiment, a curvature of the circular shape of the plural spherical surface pin grooves 15S is set to be the same as a curvature of the spherical surface shape of the leading end portions of the plural ball pins 11C. As shown in FIG. 2, when seen along the spherical surface center SC, each of the spherical surface pin grooves 15S extends along an outer peripheral surface of the retainer bushing spherical surface portion 11B on the inner peripheral surface (retainer spherical surface portion 15A) of the retainer 15. FIG. 4A is a view in which a state where the retainer 15 is swung and tilted is seen from the lower side, and FIG. 4B is a view in which the same state is seen from the front side.

The plural spherical surface pin grooves 15S are formed by the same numbers of the spherical surface pin grooves 15S as the plural ball pins 11C, the spherical surface pin grooves being arranged about the center axis of the rotation shaft 11 at equal intervals (FIG. 3B). In detail, the plural spherical surface pin grooves 15S are formed by even numbers of the spherical surface pin grooves 15S, and in more detail, formed by six spherical surface pin grooves 15S (FIG. 3B). A predetermined gap is formed between the retainer spherical surface portion 15A and the retainer bushing spherical surface portion 11B (FIG. 3B).

In the present embodiment, by respectively engaging the plural ball pins 11C with the plural spherical surface pin grooves 15S, the retainer 15 and the retainer bushing 11A are integrally rotatable about the center axis of the rotation shaft 11, and by relatively moving the plural ball pins 11C in the plural spherical surface pin grooves 15S, the retainer 15 is swingable about the spherical surface center SC. In FIG. 3B, for explanation, a gap is provided between the leading end portions of the ball pins 11C and the spherical surface pin grooves 15S. However, as described above, the curvatures of the ball pins and the spherical surface pin grooves are set to be the same. Thus, in reality, the leading end portions of the ball pins 11C are fitted into the spherical surface pin grooves 15S, and both the members are in surface contact with each other.

The sliding portion 15B is formed by a left side surface of the retainer 15, and arranged to oppose the thrust bearing 18. When the retainer 15 is rotated together with the rotation shaft 11, the sliding portion 15B slides with respect to the thrust bearing 18. The swash plate opposing portion 15C corresponds to an outer peripheral surface of the retainer 15 arranged on the radially outside of the retainer spherical surface portion 15A.

The swash plate 16 is swingably supported in the housing 10. In particular, the swash plate 16 is arranged to oppose the retainer 15 on the axially opposite side to the cylinder block 12. The swash plate 16 is swung by the tilt adjustment mechanism 17. The swash plate 16 is formed in a substantially semi-spherical shape arranged around the rotation shaft 11 so as to oppose the retainer 15, and includes a swash plate adjusting portion 161 provided to extend from an upper end portion of the substantially semi-spherical shape. The swash plate adjusting portion 161 is moved leftward and rightward by the tilt adjustment mechanism 17. As a result, the swash plate 16 is swung leftward and rightward with the spherical surface center SC of FIG. 2 as a supporting point. The swash plate 16 includes a bearing fixing portion 162 (fixing surface), a swash plate spherical surface portion 163 (supported portion), and a retainer opposing portion 164 (opposing surface) in addition to the swash plate adjusting portion 161 described above.

The thrust bearing 18 is fixed to the bearing fixing portion 162. The bearing fixing portion 162 is a ring-shaped wall surface extending in the direction orthogonal to the axial direction of the rotation shaft 11. The swash plate spherical surface portion 163 is arranged on the left side of the bearing fixing portion 162, in other words, on the axially opposite side to the bearing fixing portion 162. The swash plate spherical surface portion 163 is formed by part of a spherical surface on the spherical surface center SC concentric to the retainer bushing spherical surface portion 11B. A spherical surface shape of the swash plate spherical surface portion 163 has a second curvature which is smaller than the first curvature of the retainer bushing spherical surface portion 11B. In other words, with reference to FIG. 2, a spherical surface shape of the retainer bushing spherical surface portion 11B is a shape along a first imaginary spherical surface SP1, and the spherical surface shape of the swash plate spherical surface portion 163 is a shape along a second imaginary spherical surface SP2 concentric to the first imaginary spherical surface SP1. A radius of the second imaginary spherical surface SP2 (curvature radius of the swash plate spherical surface portion 163) is larger than a radius of the first imaginary spherical surface SP1 (curvature radius of the retainer bushing spherical surface portion 11B).

The retainer opposing portion 164 is an inner peripheral surface of the swash plate 16 arranged to oppose the swash plate opposing portion 15C of the retainer 15 in the radial direction. Although not shown in detail in FIG. 2, a predetermined gap is formed between the swash plate opposing portion 15C and the retainer opposing portion 164. In the present embodiment, the swash plate 16 is not in direct contact with the retainer 15.

The tilt adjustment mechanism 17 is arranged on the upper side of the cylinder block 12. In the tilt adjustment mechanism 17, by swinging the swash plate 16 leftward and rightward about the spherical surface center SC of FIG. 2, the retainer spherical surface portion 15A and the retainer bushing spherical surface portion 11B are brought into sliding contact with each other (relatively displaced), while the retainer 15 is swung about the spherical surface center SC through the thrust bearing 18. As a result, the tilt adjustment mechanism 17 adjusts an axially moving amount of the piston heads 13 in the reciprocating motion. That is, the tilt adjustment mechanism 17 has a function of adjusting a flow rate and a discharge amount of the piston pump 1.

The tilt adjustment mechanism 17 includes a swash plate supporting portion 171, a first tilt adjusting portion 172, and a second tilt adjusting portion 173. The swash plate supporting portion 171 is fitted into a recessed portion formed in an upper end portion of the swash plate adjusting portion 161. By drive force transmitted to the swash plate supporting portion 171, the swash plate adjusting portion 161 is swung leftward and rightward. The first tilt adjusting portion 172 biases the swash plate adjusting portion 161 from the right side. Similarly, the second tilt adjusting portion 173 biases the swash plate adjusting portion 161 from the left side. The first tilt adjusting portion 172 and the second tilt adjusting portion 173 have the same structures. Thus, hereinafter, the structure of the first tilt adjusting portion 172 will be described as an example.

The first tilt adjusting portion 172 includes a tilt piston 174, an adjustment housing 175, a shaft 176, a tilt piston spring 178, and a fixing portion 179. The adjustment housing 175 supports the members of the first tilt adjusting portion 172. The tilt piston 174 is slidingly movable in the left and right direction inside the adjustment housing 175. A leading end portion (left end portion) of the tilt piston 174 is abutted with the swash plate adjusting portion 161 of the swash plate 16. The shaft 176 is a shaft portion extending inside the adjustment housing 175. A right end portion of the adjustment housing 175 is fixed to the shaft 176 by the nut-shaped fixing portion 179. The tilt piston spring 178 formed by a coil spring is arranged between an inner peripheral portion of the tilt piston 174 and the adjustment housing 175. By bias force of the tilt piston spring 178, the tilt piston 174 biases the swash plate adjusting portion 161 leftward. O rings 175A and 177A that prevent leakage of oil are respectively arranged inside the adjustment housing 175 and in an outer peripheral portion of a tilt stopper 177. A structure of the tilt adjustment mechanism 17 is not limited to the above description as long as the swash plate 16 is swung leftward and rightward about the spherical surface center SC of FIG. 2.

The thrust bearing 18 is placed between the swash plate 16 and the retainer 15 in the axial direction of the rotation shaft 11. In detail, the thrust bearing 18 is arranged between the bearing fixing portion 162 of the swash plate 16 and the sliding portion 15B of the retainer 15. The thrust bearing 18 supports the retainer 15 in such a manner that the retainer 15 is rotatable about the center axis of the rotation shaft 11 with respect to the swash plate 16.

The swash plate receiving portion 19 (FIG. 1) is a member arranged in the housing 10 so as to oppose the swash plate 16 and formed in a substantially semi-spherical surface shape. The swash plate receiving portion 19 includes a spherical surface 19A opposing the swash plate spherical surface portion 163 (FIG. 2) of the swash plate 16. The spherical surface 19A has the same second curvature as the swash plate spherical surface portion 163 of the swash plate 16 (FIG. 2). The swash plate receiving portion 19 supports the swash plate spherical surface portion 163 of the swash plate 16 in such a manner that the swash plate 16 is swingable leftward and rightward about the spherical surface center SC. Therefore, when the swash plate 16 is swung leftward and rightward by the tilt adjustment mechanism 17, the swash plate spherical surface portion 163 is brought into sliding contact with the spherical surface 19A while in surface contact with the spherical surface 19A. As shown in FIG. 2, the swash plate receiving portion 19 is arranged in the housing 10 in such a manner that the swash plate receiving portion 19 and the thrust bearing 18 nip part of the swash plate 16 in the axial direction (left and right direction).

Further, the piston pump 1 includes a block supporting portion 26 and a block bias spring 27 (FIG. 1). The block supporting portion 26 and the block bias spring 27 are arranged on the radial position side of the piston rod 14. The block supporting portion 26 is a ring-shaped member to be abutted with the retainer bushing spherical surface portion 11B of the retainer bushing 11A (FIG. 2). A part of the block supporting portion 26 to be brought into contact with the retainer bushing spherical surface portion 11B is formed in a spherical surface shape having the same curvature as the retainer spherical surface portion 15A of the retainer 15. The block bias spring 27 is a spring member placed between the block supporting portion 26 and the cylinder block 12. The block bias spring 27 biases the cylinder block 12 toward the valve plate 25. When the cylinder block 12 is rotated, the swing of the cylinder block 12 in the axial direction (left and right direction) is reduced by elastic force of the block bias spring 27.

In a case where tilt of the piston pump 1 is adjusted, the swash plate adjusting portion 161 is moved from the state shown in FIG. 1 in the arrow D1 direction (FIG. 5) by the tilt adjustment mechanism 17. At this time, by external force applied to the swash plate supporting portion 171 (FIG. 1) being balanced with bias force of the tilt piston spring 178 of the first tilt adjusting portion 172 and the second tilt adjusting portion 173, a position of the swash plate 16 after adjustment is determined. In accordance with the movement of the swash plate adjusting portion 161, the swash plate 16 is smoothly swung in the arrow D2 direction about the spherical surface center SC (FIG. 2) along a spherical surface shape of the swash plate receiving portion 19. At this time, the retainer 15 is swung along the retainer bushing 11A in the arrow directions D3, D4 and in the arrow direction of FIG. 4B through the thrust bearing 18. At this time, the plural ball pins 11C are respectively engaged with the plural spherical surface pin grooves 15S, and by moving the plural ball pins 11C in the plural spherical surface pin grooves 15S, the retainer 15 can be swung about the spherical surface center SC (axis). In accordance with the swing of the retainer 15, the piston heads 13 coupled to the retainer 15 through the piston rods 14 are moved in the axial direction in the cylinders 12S. In particular, in FIG. 5, the piston head 13 positioned on the uppermost side is moved leftward, and the piston head 13 on the lowermost side is moved rightward (FIG. 5). As a result, in accordance with the rotation of the cylinder block 12, the volume of each of the cylinders 12S is changed. That is, in accordance with the tilt of the swash plate 16, the discharge capacity of the piston pump 1 becomes variable.

In the present embodiment, as described above, the nine cylinders 12S and the nine piston heads 13 are arranged in the cylinder block 12. In such a way, the numbers of the piston heads 13 and the cylinders 12S arranged about the center axis of the rotation shaft 11 at equal intervals are odd numbers, and the same numbers (odd numbers) of the piston rods 14 as the piston heads 13 are provided. Thus, pulsation of oil pressure occurring at the time of driving and rotating the cylinder block 12 is reduced. In other words, in a case where the numbers of the cylinders 12S and the piston heads 13 are even numbers, pulsations of the oil pressure of the cylinders 12S arranged symmetrically to each other in the radial direction are resonated with each other, and hence increased.

With reference to FIGS. 1 and 6A, a case where the tilt of the swash plate 16 is not controlled and the retainer 15 is arranged so as to be orthogonal to the axial direction of the rotation shaft 11 will be described. In this case, while each of the piston rods 14 makes one rotation about the center axis of the rotation shaft 11, each of the piston heads 13 is not moved in the axial direction at any phases. Therefore, a rotation trajectory of the retainer side end portion 142 of the piston rod 14 becomes an exact circle P1. In this case, whirling motions of the nine piston heads 13 are cancelled by each other. Thus, the swing of the cylinder block 12 about the rotation axis does not occur.

Meanwhile, with reference to FIGS. 5 and 6B, a case where the tilt of the swash plate 16 is controlled and the pushing capacity of the piston pump 1 is more than zero will be described. In this case, while each of the piston rods 14 makes one rotation about the center axis of the rotation shaft 11, an axial position of each of the piston heads 13 is changed in accordance with a phase. As a result, as shown in FIG. 6B, the rotation trajectory of the retainer side end portion 142 of the piston rod 14 becomes an oval P2. In particular, at a phase of zero degree and a phase of 180 degrees, a distance between the piston rod 14 and the rotation center of the rotation shaft 11 is shorter than the case of FIG. 6A. Meanwhile, at a phase of 90 degrees and a phase of 270 degrees, the distance between the piston rod 14 and the rotation center of the rotation shaft 11 is longer than the case of FIG. 6A. In FIG. 7, the piston rod 14 at the phase of zero degree of FIG. 6B is enlarged and shown. When the swash plate 16 is tilted as in FIG. 5, the axis line of the piston rod 14 is moved from the first imaginary axis C1 of the case of FIG. 6A to the second imaginary axis C2. At this time, the head side end portion 141 of the piston rod 14 is swung in the piston head supporting portion 13S of the piston head 13. In such a way, by changing a posture of the piston rod 14 at each phase, the rotation trajectory of the piston rod 14 becomes the oval P2 as described above. In this case, the whirling motions of the nine piston heads 13 are not cancelled by each other. As a result, the swing of the cylinder block 12 about the rotation shaft is more easily increased.

Even in such a case, in the present embodiment, the retainer 15 is supported by the retainer bushing 11A fitted to the rotation shaft 11. The retainer bushing 11A has the plural ball pins 11C, and the plural spherical surface pin grooves 15S are formed in the retainer 15. By respectively engaging the plural ball pins 11C with the plural spherical surface pin grooves 15S, the retainer 15 and the retainer bushing 11A are integrally rotatable about the center axis of the rotation shaft 11, and by relatively moving the plural ball pins 11C in the plural spherical surface pin grooves 15S, the retainer 15 is swingable about the spherical surface center SC (axis). Therefore, when the rotation shaft 11 is rotated, the rotation shaft 11, the retainer 15, and the retainer bushing 11A are integrally rotated about the center axis of the rotation shaft 11, while the cylinder block 12 is rotated integrally with the rotation shaft 11. Therefore, a rotation phase of the rotation shaft 11 is substantially matched with a rotation phase of the retainer 15. Thus, it is possible to reduce a rotation delay of the retainer 15 with respect to the cylinder block 12. As a result, abnormal tilt of the piston rods 14 is suppressed, and contact of the piston heads 13 and the piston rods 14 placed between the cylinder block 12 and the retainer 15 with peripheral members such as the retainer 15 and the cylinder block 12 is suppressed. As a result, it is possible to improve durability of the piston pump 1. Further, in the present embodiment, since the rotation shaft 11 can stably hold rotation of the plural piston heads 13, the whirling motions of the piston heads 13 are suppressed. Since a predetermined gap is formed between the swash plate opposing portion 15C of the retainer 15 and the retainer opposing portion 164 of the swash plate 16, compelling force is not applied to the retainer 15 from the radially outside. Therefore, freedom of the retainer 15 is ensured, and the whirling motions of the piston heads 13 are more easily absorbed.

In the present embodiment, since the retainer spherical surface portion 15A of the retainer 15 and the retainer bushing spherical surface portion 11B of the retainer bushing 11A are formed in a spherical surface shape having the same first curvature, the retainer 15 can be easily turned along the retainer bussing 11A at the time of adjusting the tilt. Further, the swash plate receiving portion 19 is formed in a spherical surface shape concentric to the spherical surface shape of the retainer bushing spherical surface portion 11B when seen in a section of FIG. 1. Thus, the retainer 15 can promptly be swung in conjunction with the swing of the swash plate 16. Therefore, the tilt of the swash plate 16 is performed smoothly in conjunction with the movement of the retainer 15, the piston rods 14, and the piston heads 13, and it is possible to enhance a response property of tilt control. In such a structure, since the discharge capacity of the piston pump 1 is adjusted, there is no need for tilting the cylinder block 12 with respect to the rotation shaft 11. Thus, complication of a tilt control mechanism of the piston pump 1 is suppressed.

In the present embodiment, as shown in FIG. 7, the head side end portion 141 of the piston rod 14 is swingable in the radial direction with respect to the piston head 13 (arrow DM of FIG. 7), and the retainer side end portion 142 is swingable in the radial direction with respect to the retainer 15 (arrow DN of FIG. 7). In other words, the head side end portion 141 and the retainer side end portion 142 of the piston rod 14 have rotation freedom with respect to the piston head 13 and the retainer 15, respectively. Therefore, radial swing, backlash of the piston head 13 occurring at the time of rotating the cylinder block 12 is absorbed by the swing of the piston rod 14. Further, a contact portion between the piston head 13 and the piston rod 14, and a contact portion between the piston head 13 and the retainer 15 are formed along the spherical surface shape of the head side end portion 141 and the retainer side end portion 142. Therefore, by increasing a contact area, surface pressure of the piston rod 14 is reduced, and galling of the piston rod 14 at the time of driving is suppressed. Even when a supply amount of lubricating oil through the oil groove 143 (FIG. 1) is low, galling does not easily occur. Thus, it is possible to improve pump (volumetric) efficiency of the piston pump 1.

Further, in the present embodiment, the retainer 15 and the swash plate 16 are connected to each other by the thrust bearing 18. Therefore, in comparison to other liquid pressure rotary machine in which members are brought into contact with each other through no bearings, it is possible to reduce sliding resistance occurring at the time of rotation. In the present embodiment, the reciprocating piston heads 13 and the swash plate 16 are not in direct contact with each other. Therefore, it is possible to set a low leakage amount of the working oil supplied to a sliding part in the piston pump 1 as a lubricant, and it is possible to improve the volumetric efficiency of the piston pump 1 (liquid pressure rotary machine). In the present embodiment, the retainer 15 is supported by the retainer bushing 11A and a predetermined gap is formed between the swash plate opposing portion 15C of the retainer 15 and the retainer opposing portion 164 of the swash plate 16. Therefore, in comparison to a case where a radial bearing is arranged between the retainer 15 and the swash plate 16, radial size of the piston pump 1 can be set compactly.

Further, in the present embodiment, as shown in FIG. 2, the swash plate receiving portion 19 is arranged in the housing 10 in such a manner that the swash plate receiving portion 19 and the thrust bearing 18 nip part of the swash plate 16 along the axial direction. Therefore, even in a case where strong pressing force is applied to the retainer 15 leftward by the reciprocating motion of the piston heads 13, the thrust bearing 18 and the swash plate 16 can stably support the retainer 15.

Further, in the present embodiment, when seen in the section orthogonal to the center axis of the rotation shaft 11 (FIG. 3B), the plural spherical surface pin grooves 15S of the retainer 15 are formed in a recessed circular shape. The curvature of the circular shape of the plural spherical surface pin grooves 15S is set to be the same as the curvature of the spherical surface shape of the leading end portions of the plural ball pins 11C of the retainer bushing 11A. With such a configuration, since surface pressure generated in the leading end portions of the ball pins 11C is uniformized, it is possible to improve durability of the ball pins 11C. Since sliding resistance between the ball pins 11C and the spherical surface pin grooves 15S at the time of rotating the retainer 15 is reduced, it is possible to improve efficiency of the piston pump 1.

In the present embodiment, the plural ball pins 11C are formed by even numbers of the ball pins 11C arranged about the center axis of the rotation shaft 11 at equal intervals, and the plural spherical surface pin grooves 15S are formed by the same numbers of the spherical surface pin grooves 15S as the plural ball pins 11C, the spherical surface pin grooves being arranged about the center axis at equal intervals. In this case, since the retainer 15 is stably supported by the retainer bushing 11A, it is possible to stably realize the swing of the retainer 15 about the spherical surface center SC and rotation of the retainer 15 about the rotation shaft 11. Arrangement and the numbers of the ball pins 11C and the spherical surface pin grooves 15S are not limited to the above description. For example, the numbers of the ball pins 11C and the spherical surface pin grooves 15S may respectively be even numbers. In a case where the piston pump 1 is used at a low load, at least one ball pin 11C and one spherical surface pin groove 15S may be arranged. By providing the plural ball pins 11C and the plural spherical surface pin grooves 15S, it is possible to stably and substantially match the rotation phase of the rotation shaft 11 with the rotation phase of the retainer 15.

Further, in the present embodiment, the plural piston heads 13 are formed by odd numbers of the piston heads 13 arranged about the center axis of the rotation shaft 11 at equal intervals, and the plural piston rods 14 are formed by the same numbers of the piston rods 14 as the piston heads 13, the piston rods being arranged about the center axis at equal intervals. With such a configuration, it is possible to reduce the pulsation of the oil pressure occurring at the time of driving and rotating the cylinder block 12. However, arrangement and the numbers of the piston heads 13 and the piston rods 14 are not limited to the above description. In a case where the pulsation of the oil pressure is not excessive or in a case where the pulsation of the oil pressure can be solved by structures other than the arrangement and the numbers of the piston heads 13 and the piston rods 14, the numbers of the piston heads 13 and the piston rods 14 may respectively be even numbers.

The piston pump 1 (liquid pressure rotary machine) according to the embodiment of the present invention is described above. The present invention is not limited to these modes. As a liquid pressure rotary machine according to the present invention, modified embodiments as described below are available.

Figure 8:
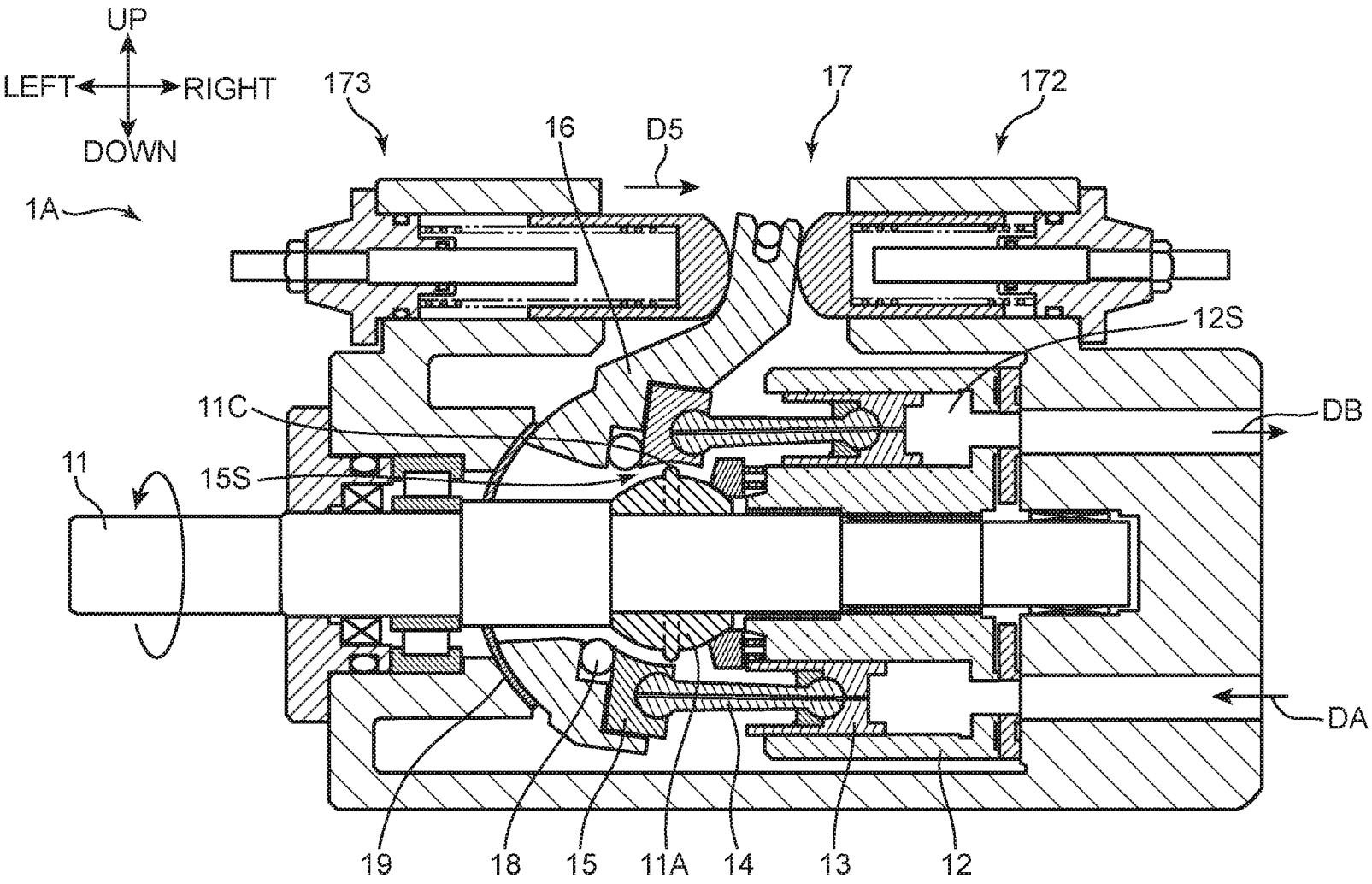
FIG. 8 is a sectional view of a case where a liquid pressure rotary machine according to a modified embodiment of the present invention is used as a hydraulic motor.

(1) In the above embodiment, the piston pump 1 is described as the variable capacity type liquid pressure rotary machine. However, the present invention is not limited to this. FIG. 8 is the sectional view of the case where the liquid pressure rotary machine according to the modified embodiment of the present invention is used as the piston motor 1A (hydraulic motor). As an example, in the piston motor 1A of FIG. 8, the swash plate 16 is swung in the arrow D5 direction by the tilt adjustment mechanism 17. As a result, an opposite phase to the case of FIG. 5 occurs in each of the piston heads 13. In the plural cylinders 12S, high-pressure working oil flows into the cylinder 12S whose volume is small as an arrow DA. As a result, the flowing working oil acts on the piston head 13, and the piston head 13 is pressed leftward. This moving force of the piston head 13 is converted to rotate the cylinder block 12 and the rotation shaft 11 through the retainer 15. By rotating the rotation shaft 11 in the arrow direction of FIG. 8, the piston motor 1A functions as a motor. When the piston head 13 on the high pressure side is rotated together with the retainer 15 and moved to the low pressure side (piston head 13 on the upper side of FIG. 8), the working oil is discharged in the arrow DB direction. Even in the piston motor 1A of FIG. 8, by swinging the retainer 15 along the spherical surface shape of the retainer bushing 11A, variable capacity control of the piston motor 1A is realized. Since the head side end portion and the retainer side end portion of the piston rod 14 are swingable at least in the radial direction with respect to the piston head 13 and the retainer 15, the whirling motion of the piston head 13 at the time of driving and rotating is suppressed. The other operations and effects can be obtained as well as the above embodiment.

(2) In the above embodiment, the mode in which the head side end portion 141 and the retainer side end portion 142 of the piston rod 14 are formed in a spherical surface shape is described. However, the present invention is not limited to this. The head side end portion 141 and the retainer side end portion 142 may be formed in an arc shape when seen in a section along the axial direction of the rotation shaft 11 as shown in FIG. 1, and have predetermined thickness in the direction orthogonal to the paper plane of FIG. 1. In this case, the piston head supporting portion 13S of the piston head 13 and the retainer supporting portion 15D of the retainer 15 (FIG. 7) may also be formed in a predetermined arc shape in a sectional view, so as to support the head side end portion 141 and the retainer side end portion 142. Even in this case, the head side end portion 141 and the retainer side end portion 142 are also swingable (relatively rotatable) in the radial direction while in line contact along the arcs of the piston head 13 and the retainer 15, respectively. Therefore, at the time of rotating the cylinder block 12, radial swing of the piston head 13 is absorbed.

(3) In the above embodiment, the mode in which the retainer bushing 11A is formed in a continuous spherical surface shape along the rotation direction of the rotation shaft 11 is described. However, the present invention is not limited to this. As long as the retainer bushing 11A can swingably support the retainer 15, part of the spherical surface shape may be non-continuously arranged at intervals along the rotation direction.

What is claimed is:

1. A variable capacity type liquid pressure rotary machine comprising: a housing; a rotation shaft rotatably and axially supported by the housing; a cylinder block including plural cylinders arranged and spaced from each other about the rotation shaft, the cylinder block to be rotated about a center axis of the rotation shaft integrally with the rotation shaft; plural pistons respectively housed in the plural cylinders of the cylinder block, the pistons performing reciprocating motion in accordance with rotation of the cylinder block along an axial direction of the cylinder block; a retainer bushing including a bushing outer peripheral surface having a spherical surface shape projected radially outward in relation to the rotation shaft, the retainer bushing being supported on the rotation shaft so as to be rotatable about the center axis together with the rotation shaft; a retainer including a retainer inner peripheral surface which is formed in a recessed spherical surface shape arranged to oppose the bushing outer peripheral surface, the retainer being supported by the retainer bushing so as to be swingable about an orthogonal axis which is orthogonal to the center axis of the rotation shaft; plural piston rods arranged to extend in the axial direction, the piston rods respectively connect the plural pistons and the retainer and rotate the retainer about the center axis in conjunction with rotation of the cylinder block about the center axis; a swash plate arranged to oppose the retainer on an axially opposite side to the cylinder block, the swash plate being supported by the housing so as to be swingable about the orthogonal axis; a thrust placed between the swash plate and the retainer in an axial direction, the thrust bearing that supports the retainer in such a manner that the retainer is rotatable about the center axis with respect to the swash plate; and a tilt adjustment mechanism that, by swinging the swash plate about the orthogonal axis, swings the retainer about the orthogonal axis through the thrust bearing while relatively displacing the retainer inner peripheral surface relative to the bushing outer peripheral surface, and adjusts an axially moving amount of the pistons, wherein the retainer bushing has at least one projecting portion projecting radially outward from the bushing outer peripheral surface and having a leading end portion in a radially outward direction formed in a spherical surface shape, at least one groove portion extending along a direction in which the retainer is swung about the orthogonal axis is formed on the retainer inner peripheral surface of the retainer, and by engaging the at least one projecting portion with the at least one groove portion, the retainer and the retainer bushing are integrally rotatable about the center axis, and by moving the at least one projecting portion in the at least one groove portion, the retainer is swingable about the orthogonal axis.

2. The liquid pressure rotary machine according to claim 1, wherein the at least one projecting portion includes plural projecting portions arranged and spaced from each other along a rotation direction of the rotation shaft, and the at least one groove portion includes plural groove portions arranged and spaced from each other along the rotation direction.

3. The liquid pressure rotary machine according to claim 2, wherein the plural groove portions are formed in a recessed circular shape when seen in a section orthogonal to the center axis, and a curvature of the circular shape of the plural groove portions is set to be the same as a curvature of the spherical surface shape of the leading end portions of the plural projecting portions.

4. The liquid pressure rotary machine according to claim 2, wherein the retainer has an even number of the projecting portions arranged about the center axis at equal intervals, and the retainer inner peripheral surface is formed with the same number of the groove portions as the plural projecting portions, the groove portions being arranged about the center axis at equal intervals.

5. The liquid pressure rotary machine according to claim 4, wherein in the cylinder block, an odd number of the pistons are arranged about the center axis at equal intervals, and the same number of the piston rods as the pistons are provided in the cylinder block, the piston rods being arranged about the center axis at equal intervals.

* * * * *